US008506032B2

(12) United States Patent
Baumgartner

(10) Patent No.: US 8,506,032 B2
(45) Date of Patent: Aug. 13, 2013

(54) METHOD TO CONTROL A PRINTING PROCESS IN AN INKJET PRINTING APPARATUS, AND PRINTING APPARATUS TO EXECUTE SUCH A METHOD

(75) Inventor: Robert Baumgartner, Wörth (DE)

(73) Assignee: Océ Printing Systems GmbH, Poing (DE)

( * ) Notice: Subject to any disclaimer, the term of this patent is extended or adjusted under 35 U.S.C. 154(b) by 95 days.

(21) Appl. No.: 13/248,129

(22) Filed: Sep. 29, 2011

(65) Prior Publication Data

US 2012/0075371 A1 Mar. 29, 2012

(30) Foreign Application Priority Data

Sep. 29, 2010 (DE) ..... 10 2010 037 854

(51) Int. Cl.
*B41J 29/38* (2006.01)
*B41J 2/155* (2006.01)

(52) U.S. Cl.
USPC ..... 347/10; 347/42

(58) Field of Classification Search
None
See application file for complete search history.

(56) References Cited

U.S. PATENT DOCUMENTS 5,355,441 A 10/1994 Kawai et al.
5,619,623 A * 4/1997 Takayanagi et al. ..... 358/1.15
2006/0082812 A1 4/2006 Gardner et al.

FOREIGN PATENT DOCUMENTS

GB GB 2 433 341 A 6/2007

OTHER PUBLICATIONS

U.S. Appl. No. 13/223,511, filed Sep. 1, 2011, Inventors: Robert Baumgartner et al.

* cited by examiner

*Primary Examiner* — Geoffrey Mruk
(74) *Attorney, Agent, or Firm* — Schiff Hardin LLP

(57) ABSTRACT

In a method or apparatus for controlling a printing process in an inkjet printing apparatus that has multiple print heads, a line scan is generated to print a print line on a recording material. The individual print heads are individually controlled with an offset relative to the line scan to eject printing ink, print data prepared for the printing being stored in a memory device upstream of the print heads. Print data units to be printed by the print heads are transferred from the memory device to the respective print heads in a same order with which they are printed. The order with which the print data units are transferred is controlled by request commands entered into a FIFO memory, each request command identifying a print head in the order of the transfer of the print data units corresponds to an order of the request commands in the FIFO memory.

8 Claims, 2 Drawing Sheets

METHOD TO CONTROL A PRINTING PROCESS IN AN INKJET PRINTING APPARATUS, AND PRINTING APPARATUS TO EXECUTE SUCH A METHOD

BACKGROUND

The present preferred embodiment concerns a method to control the printing process in an inkjet printing apparatus and a printing apparatus to execute such a method.

In the subsequently disclosed German Patent Application DE 10 2010 037 303 by the applicant, a method and a device are described in which pixel data contained in the print data stream are sorted such that segments of the sorted pixel data (that are designated as print data units in the following) can be supplied directly to the print heads of an inkjet printing apparatus to activate the printing process. These sorted print data are stored in a memory device and supplied from there to the print heads.

In digital high-capacity printing, large data streams must be managed and the data must be distributed correctly to a plurality of print heads. The print heads have data registers that are respectively designed to accommodate only one print data unit. During a printing process in which printing ink is ejected from inkjet nozzles onto a recording material, the individual inkjet nozzles of the print heads are activated simultaneously by means of the print data unit, wherein a bit combination of the print data unit is respectively associated with an inkjet nozzle such that the nozzle ejects a defined sequence of ink droplets depending on the received bit combination. After such a printing process a new print data unit must be imported into the data register. Since the printing processes repeat periodically with high frequency, the print data units must respectively be supplied correspondingly quickly between two printing processes.

Conventional high-capacity inkjet printing apparatuses have a plurality of print heads. The individual print heads must be aligned exactly relative to one another. Micro-adjustment devices are known for this in order to enable the necessary precision of the adjustment. In current modern print heads, inkjet dots with a diameter of 42 μm (for example) are generated on a recording material. The individual print heads must accordingly be aligned precisely relative to one another. An offset of a print head by half of a diameter of an inkjet dot already generates printing errors that are immediately perceptible to the naked eye.

From GB 2 433 341 A a method is described for processing print data in which print data are supplied from a USB input interface via a first in first out memory (FIFO memory) to a print data controller, activation data are determined there from the print data and these activation data are then transferred to a print head.

From US 2006/0082812 A1 a printing system is known in which print data that are received from different sources (state machines) are sorted using queues and brought into a correct order for printing.

From U.S. Pat. No. 5,355,441 A a print controller is known in which two print memories are provided, namely a first memory that serves for buffering and fast generation of rastered print image data of only a portion of a print page and a second memory in which a complete rastered print page can respectively be stored.

By means of an incremental encoder it is known to generate a line scan that scans the movement of a recording material to be printed, such that one print line on the recording material is printed with each scan.

Furthermore, in the Patent Application DE 10 2009 038 480 by the applicant a device and a method are disclosed for scanning a web movement to control a handling process, in which an incremental encoder is used to scan the web movement. Given a backwards movement of the material web (which backward movement is not provided per se), the output of the signals generated by the incremental encoder is suppressed, and these signals are only output again when a forwards movement follows the backwards movement, wherein the path of the forwards movement corresponds to the path of the previously executed backwards movement. Only after this are the signals of the incremental encoder output as control signals again.

In the subsequently published Patent Application DE 10 2010 017 004 by the applicant it is described to modify the signals to activate a print head of an inkjet printer depending on the web speed of a recording material to be printed in order to compensate for the flight time of the ink droplets.

The content of the aforementioned patent applications is herewith incorporated by reference into the present Specification.

SUMMARY

It is an object to achieve a method and a printing apparatus with which the print images generated by different print heads can be adjusted in a simple manner.

In a method or apparatus for controlling a printing process in an inkjet printing apparatus that has multiple print heads, a line scan is generated to print a print line on a recording material. The individual print heads are individually controlled with an offset relative to the line scan to eject printing ink, print data prepared for the printing being stored in a memory device upstream of the print heads. Print data units to be printed by the print heads are transferred from the memory device to the respective print heads in a same order with which they are printed. The order with which the print data units are transferred is controlled by request commands entered into a FIFO memory, each request command identifying a print head in the order of the transfer of the print data units corresponds to an order of the request commands in the FIFO memory.

DESCRIPTION OF THE PREFERRED EXEMPLARY EMBODIMENT

Figure 1:
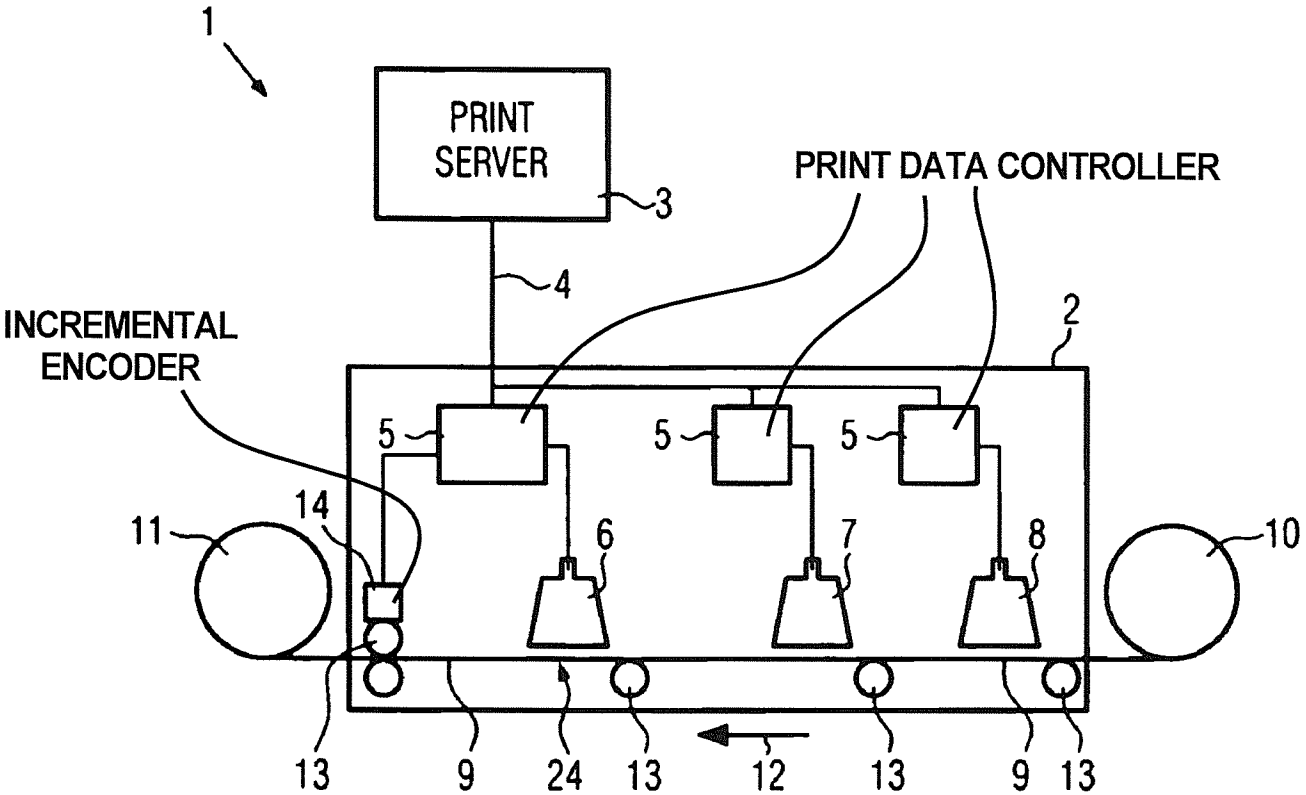
FIG. 1 illustrates schematically a printing system according to the preferred embodiment in a block diagram.

For the purposes of promoting an understanding of the principles of the invention, reference will now be made to the preferred exemplary embodiment/best mode illustrated in the drawings and specific language will be used to describe the same. It will nevertheless be understood that no limitation of the scope of the invention is thereby intended, and such alterations and further modifications in the illustrated embodiment and such further applications of the principles of the invention as illustrated as would normally occur to one skilled in the art to which the invention relates are included.

In the method according to the preferred embodiment for controlling the printing process in an inkjet printing apparatus with multiple print heads with multiple nozzles arranged in rows, for printing print lines on a recording material a line scan is generated, wherein the individual print heads are individually controlled with an offset relative to the line scan to eject printing ink from the nozzles.

Since the individual print heads are activated individually with an offset relative to the line scan, it is unnecessary to mechanically adjust the individual print heads. The adjustment of the print image takes place via a corresponding setting of the offset of the print heads. Since the activation offset of the print heads for each individual print head is individually adjustable, the print image generated by each individual print head can be optimally aligned with regard to an optimal position merely by inputting a corresponding offset value. The adjustment of the print images is thus significantly simpler and can be executed more quickly.

The setting of the offset takes place in that an image printed on a recording material is measured, for example, wherein the spatial offset of the print images generated by the different print heads is measured. For the individual print heads an offset value is respectively stored that is then provided for activation of the individual print heads in the printing processes.

The offset is advantageously established with a precision that corresponds to one line scan or a fraction of a line scan with which the print heads are activated. The print heads can hereby simply be activated by counting corresponding scans. The time interval of the scans—and therefore the precision of the offset—typically corresponds to a spatial interval that is smaller than the diameter of a maximum image point. In inkjet printers, it is possible that image points can be printed with different sizes. The largest possible printable image point is therefore designated as a maximum image point. The precision of the offset advantageously does not amount to more than half or not more than a tenth (and in particular a twelfth) of the diameter of the maximum image point. A respective required image quality can be achieved via the selection of a corresponding upper limit of the offset precision.

The detection of the offsets typically takes place manually. However, it is also possible to establish the offsets automatically by means of corresponding optical sensors and image processing devices and to automatically adjust the print image of the inkjet printing apparatus.

The line scan is advantageously generated by means of an incremental encoder that measures the relative movement between the print heads and the recording material, wherein the incremental encoder generates a pulse signal that comprises multiple pulses between two line scans, and using these pulses the individual print heads are activated to eject printing ink. The resolution of the incremental encoder is thus greater than the line scan with which the successive lines are to be printed. Since the resolution of the pulse signal of the incremental encoder is greater than the line scan, by means of this signal it is possible to also trigger a printing process at points in time between the line scan. An offset relative to the line scan can herewith be realized in a simple manner for the ejection of printing ink.

The print data prepared for the printing with the print heads are stored in a memory device upstream of the print heads, wherein the print data units to be printed by the individual print heads are transferred from the memory device to the respective print heads in the order with which they are printed on the recording material.

The print data units read out from the memory device can initially be stored in a buffer from which they are transferred to the respective print heads as soon as a previous print data unit to be printed with the respective print head has been printed.

A dual-ported RAM is advantageously used as a buffer. A dual-ported RAM is a memory in which each memory cell can be activated with two sets of terminals, wherein the memory cells can be both read and written to by means of the two sets of terminals. Print data units can hereby be written into the buffer and read from the buffer simultaneously. The writing and reading of the print data units into the buffer are thus decoupled. The reading of the print data units for each individual print head must take place with a frequency that corresponds precisely to the line scan. Since a printing apparatus can comprise a plurality of print heads, the read frequency with which all print data units must be read from the buffer is correspondingly higher. Since the writing of the print data into the buffer is decoupled from the reading from said buffer, the writing can take place independent of the control signal, in particular independent of the pulse signal (generated by the incremental encoder) with which the print heads are activated to eject printing ink.

The order with which the print data units are transferred from the memory device to the print heads is controlled by means of request commands that are entered into a FIFO (first in first out) memory. In a FIFO memory the data are read out in the order in which they are stored, wherein data stored first are also read out first. Each request command identifies one print head. The order of the transfer of the print data units corresponds to the order of the request commands in the FIFO memory.

The use of such a FIFO memory produces multiple advantages. On the one hand, the request commands can be entered into the FIFO memory at a predetermined clock rate that, for example, corresponds to the pulse signal of the incremental encoder. The execution of the request commands is decoupled from the rate with which these are entered into the FIFO memory. Typically it is not possible to read out and relay multiple print data units simultaneously and in parallel from a memory device; rather, these can merely be read individually, in succession, and be transmitted to the buffer. Via the use of the FIFO memory, the individual request commands can be executed successively without interruption so that the print data units can be read out from the memory device and can be transferred into a buffer with a maximum data rate.

The request commands can be entered into the FIFO memory in any order. The order with which the print data units are transferred from the memory device to the buffer can hereby be set arbitrarily. The order of the request commands in the FIFO memory advantageously corresponds to the order in which the corresponding print data units are used to activate the corresponding print heads. This is in particular advantageous in connection with the adjustment of the print image explained above since the order with which the individual print heads eject printing ink can be freely selected in the printing apparatus and can be established only in the adjustment.

A printing apparatus according to the preferred embodiment comprises multiple print heads and an incremental encoder to generate a pulse signal that has a more exact resolution than a line scan with which the individual successive lines are to be printed. The printing apparatus also comprises a control device to activate the print heads, wherein the print heads can be activated individually, and can be offset relative to the line scan, using the pulse signal.

The printing apparatus advantageously has a memory unit to store the print data to be printed and a readout module to read out print data units from the memory device and to relay the print data units to one of the respective print heads. The readout module is connected with a FIFO memory into which a request module writes request commands, wherein with each request command it is defined in which print head a print data unit is requested.

The request module can be connected with a register in which the offset of the activation of the individual print heads relative to the line scan is defined. The offset can be defined by a binary number with only a few bits (for example 3 bits). The precision of the offset is established by the value of an individual bit, which is advantageously not greater than the diameter of a maximum image point and in particular amounts to a fraction of the image point.

Furthermore, the request module can be connected with the incremental encoder. Depending on the pulse signals of the incremental encoder, the request commands are entered by the request module into the FIFO memory corresponding to the order stored in the register.

The printing apparatus advantageously has a buffer that comprises multiple memory units that are respectively associated with a print head. The readout module writes the print data units read from the memory device into the memory units. The individual memory units are advantageously designed to be independent of one another, such that multiple memory units can be activated simultaneously and print data units can be read out from them simultaneously and be relayed to the corresponding print heads.

The buffer is advantageously designed as a dual-ported RAM so that the individual memory units can be written to and read simultaneously. The individual memory units advantageously have a capacity to store two print data units so that one print data unit can be written into a memory unit and another print data unit can be read out from the memory unit simultaneously.

The printing apparatus can be provided with an activation module with a register in which the offset of the activation of the individual print heads relative to the line scan is defined. The activation module is connected with the incremental encoder, wherein the activation module is designed such that—depending on the offsets (stored in the register) in the respective pulse signals of the incremental encoder—it reads the corresponding print data unit out of one of the memory units of the buffer and relays these to the respective print head.

The print head is a contiguous unit of inkjet nozzles that can be activated simultaneously by means of a print data unit. For example, a print head can have multiple rows of inkjet nozzles, wherein one memory register to accommodate a print data unit is associated with each row and the individual rows can be activated independently of one another. For example, in the sense of the present preferred embodiment each individual row of inkjet nozzles that can be activated independently of the other rows by means of the print data unit can also represent a print head.

Such arrangements with multiple rows of inkjet nozzles that can be activated independently of one another are designated as print head arrangements in the following.

The preferred embodiment is explained in detail in the following as an example, using the exemplary preferred embodiment presented in the drawings.

FIG. 1 shows a printing system 1 with a printing apparatus 2 designed according to the exemplary embodiment. The printing system 1 additionally comprises a print server 3 to which the printing apparatus 2 is connected by means of a data line 4. In the printing apparatus 2 the data line 4 is connected to print data controllers 5. The print data controllers 5 process the print data stream arriving from the print server 3, wherein this processing can comprise different processing steps. The print data stream comprises pixel data that are sorted in the print data controller 5. These print data are also rastered as needed. This depends on whether the print data are immediately suitable for activation of the print head arrangements 6, 7, 8 connected with the print data controller 5 or whether they must be rastered in corresponding half tones. Each print data controller normally controls a print head arrangement 6, 7, 8 that respectively has multiple print heads.

In the present exemplary embodiment each print head comprises multiple rows of inkjet nozzles with which a data register is respectively associated. The individual print heads can be activated independently of one another. The individual print head arrangements 6, 7, 8 serve to print different colors on a recording material 9 (which is a paper web) that is unrolled from an input roller 10 and rolled up on an output roller 11.

The web-shaped recording material 9 is moved in a transport direction 12 along a transport path 24. The transport path 24 is defined by rollers 13 that are arranged above and below the transport path. One of the rollers 13 is provided with an incremental encoder 14 to scan the web movement of the recording material 9. The incremental encoder 14 is connected with the print data controller 5 and delivers the current position of the recording material 9 in the form of a pulse signal. The interval between two pulses of the pulse signal means that the recording material 9 has covered a predetermined path (δs) in the transport direction 12. The incremental encoder 14 is designed so that the path of the recording material 9 between two pulses of the pulse signal amounts to a fraction of the separation between two print lines. This fraction can be 1/12, for example. This means that 12 pulses are generated upon covering a distance between two print lines of the recording material 12.

The incremental encoder and the devices connected with the incremental encoder are advantageously designed to prepare the pulse signal as is disclosed in the Patent Application DE 10 2009 038 480 or in the Patent Application DE 10 2010 017 004. These two documents are therefore referenced here again.

Figure 2:
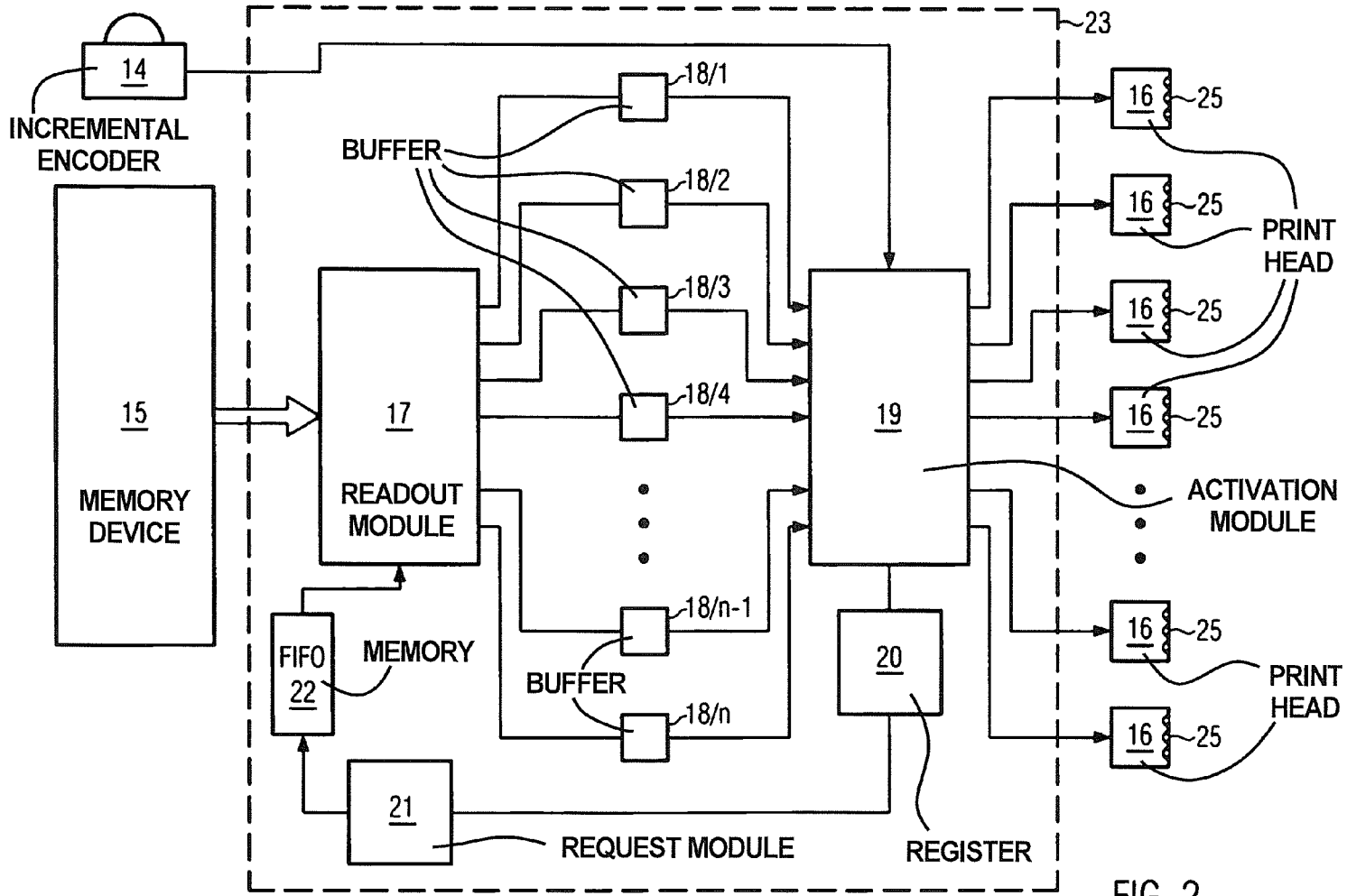
FIG. 2 illustrates schematically a circuit arrangement according to the preferred embodiment to transfer print data from a memory device to the print heads in a block diagram.

FIG. 2 schematically shows a circuit 23 to transfer print data units from a memory device 15 to respective print heads 16 that respectively have a plurality of nozzles 25 arranged in lines, via which nozzles 25 printing ink is ejected for per-dot printing of the print data units. The print heads 16 have additional electronic and/or mechanical components (not shown here), for example piezo-elements or heating elements for ejection of the printing ink. With the exception of the incremental encoder 14 and the print heads 16, the circuit 23 shown in FIG. 2 is a component of each of the print data controllers 5.

The memory device 15 is designed as a non-volatile semiconductor memory (SRAM). The print data prepared for activation of the print heads 16 are stored in the memory device 15. For example, the preparation of the print data (which can take place in the print data controller 5) comprises the sorting of the pixel data and/or rastering of the pixel data. The German Patent Application DE 10 2010 037 303 is referenced here in this regard. The pixel data are sorted such that in the memory device they form print data units that can be supplied directly to one of the print heads 16 without further processing in order to activate the print heads 16.

The memory device 15 is connected with a readout module 17 that reads out the print data units and supplies these to a buffer 18 with multiple memory units 18/1, 18/2 . . . **18/*n*. The buffer 18 is formed from a dual-ported RAM, wherein each memory unit has a memory capacity to accommodate at least two print data units. It is hereby possible that a print data unit is stored in a memory unit of the buffer 18** and another print data unit is read out at the same time. The individual memory units are independent of one another, such that they can be read simultaneously.

The reading of the buffer 18 or of the memory units is executed by an activation module 19. The activation module 19 is therefore connected with the individual memory units of the buffer 18. Moreover, the activation module 19 is connected with the incremental encoder 14 and a register 20.

At the output side the activation module 19 is connected with the print heads 16 via data lines.

The offsets of the respective print heads 16 connected with the print data controller 5 are stored in the register 20. The offsets are shown in the form of the number of pulses of the pulse signal relative to the line scan. Each offset is respectively associated with a print head. This association can, for example, be established in the register via the position of the respective bits that described the offset. The offset relative to the line scan is thus defined in the register 20 for each print head 16 connected with the data controller 5. The activation module 19 is designed such that it respectively detects the line scan using the pulse signal of the incremental encoder 14 and then activates the individual print heads 16 corresponding to the offsets indicated in the register 20. For example, if the incremental encoder generates 12 pulses per line scan, the activation module counts the pulses and uses each 12th pulse as a line scan. The corresponding print data unit is activated every time at an n-th pulse of the pulse signal after the line scan, wherein n is the offset stored in the register. The print data unit is hereby read out from the corresponding memory unit of the buffer 18 and is transmitted to the respective print head 16. The activation module 19 thus allows a parallel activation of multiple print heads 16, wherein the clock speed of the activation module 19 is provided by the pulse signal of the incremental encoder 14.

By counting the pulses generated by the incremental encoder, from the spatial offset a time delay is generated with which the print heads are activated, wherein the delay of the activation of the individual print heads compensates for the offset in the print image on the recording material due to pulses varying depending on the transport or print speed in the time interval.

Via the offsets of the activation of the individual print heads 16, the offsets being defined in the register 20, it is possible to align the print image of the individual print heads 16 relative to one another. Since a separate offset value is stored for each print head 16 in the register 20, all print heads 16 can be activated individually. This means that the print images generated with the individual print heads 16 can be adjusted individually.

The adjustment can be made by an experienced operator who analyzes the print image generated with the printing apparatus 2 according to the preferred embodiment and sets the offsets accordingly. However, within the scope of the preferred embodiment it is also possible to detect the print image automatically by means of a camera. The print image detected by the camera can then be subjected to an automatic image analysis with which the offset of the print images generated by the different print heads 16 is determined and the values for the offsets in the register 20 can be created automatically.

Via the use of the offsets stored in the register 20, it is not necessary to mechanically align the individual print heads relative to one another, which has previously been very complicated.

Furthermore, a request module 21 is provided in this circuit 23, with which request module 21 request commands are generated in order to read the print data units from the memory device 15 by means of the readout module 17. The request module 21 is coupled with the readout module 17 by means of a FIFO memory 22. The FIFO memory 22 serves to buffer the request commands, wherein the first request commands stored therein by the request module 21 are also relayed to the readout module 17. The request module 21 is connected with the register 20 and generates the request commands in the order in which the print heads 16 are to be activated. This order is established by the offsets (defined in the register 20) relative to the line scan. The request commands for print heads 16 to be activated simultaneously are stored in immediate succession in the FIFO memory 22. The request commands generated by the request module 21 advantageously comprise only a code or an address of the respective print heads 16. Using this address the readout module 17 detects which print data unit is to be read out from the memory device 15 and in which memory cell of the buffer 18 this memory unit is to be stored.

The request module 21 is connected with the incremental encoder 14 and generates the request commands according to the requirements of the pulse signal of the incremental encoder 14, wherein the request commands of a few pulses are generated before the actual point in time of the activation of the corresponding print heads 16 so that sufficient time remains in order to read the print data units from the memory device 15 and relay them to the print heads 16 by means of the buffer 18.

The readout module 17 executes the request commands in the order in which it reads them out from the FIFO memory 22, wherein the execution takes place without interruption as long as the FIFO memory 22 contains corresponding request commands. Since the readout module 17 reads out the print data units in succession (serially) and stores them in the buffer and since the subsequent relaying of the print data units can take place in parallel, the readout of the print data units from the memory device 15 represents the bottleneck in the data stream of the print data from the memory device to the print heads 16. Therefore it is advantageous that a data stream that is continuous to the greatest possible extent is achieved via the decoupling of the generation of the request commands and the execution of the request commands by means of the FIFO memory.

The offsets stored in the register 20 serve not only to establish the order of the activation of the individual print heads but also to establish the order of the readout of the print data units by means of the readout module 17. Since the readout module 17 is decoupled from the clock speed of the activation module 19 by means of the readout module, the readout of the memory device 15 can take place virtually continuously. This decoupling between readout module 17 and activation module 19 is also supported by the buffer 18 designed as a dual-ported RAM, in which buffer 18 the writing and the reading of the print data units can take place completely independently of one another and in particular can also take place simultaneously.

The present exemplary embodiment primarily serves to control the printing process in an inkjet printer. The decoupling of the readout of a memory device from the activation of multiple devices (here the print heads 16) can also reasonably be used in other applications outside of printing apparatuses insofar as the devices to be activated are to be activated according to a predetermined, externally provided clock pulse, wherein the clock frequency is so high that the readout of the memory device with this high clock frequency is not always possible.

The present exemplary embodiment of the circuit 23 was realized with an FPGA that is available under the commercial name Virtex5 XC5VLX50T-FF1136#. This FPGA has what are known as distributed RAMs that can be freely configured by means of the Xilinx CORE Generator software, wherein the individual memory blocks can be initialized in large numbers both as a single-ported RAM and as a dual-ported RAM with regard to the address and the data line. Therefore the readout module 17, the buffer 18, the activation module 19, the register 20, the request module 21, and the FIFO memory 22 can be represented in this FPGA.

The method described above to control the printing process in an inkjet printing apparatus can be briefly summarized as follows.

A line scan is generated to print a print line on a recording material. To eject printing ink, the individual print heads are individually activated with an offset relative to the line scan. The print image of the individual print heads can be adjusted individually by setting the offset without a mechanical adjustment of the print heads being necessary. According to a preferred embodiment, the readout of print data units to activate the print heads takes place decoupled from the line scan or a pulse signal provided by an incremental encoder that serves to activate the individual print heads.

Although a preferred exemplary embodiment is shown and described in detail in the drawings and in the preceding specification, it should be viewed as purely exemplary and not as limiting the invention. It is noted that only a preferred exemplary embodiment is shown and described, and all variations and modifications that presently or in the future lie within the protective scope of the invention should be protected.

I claim as my invention:

1. A method for controlling a printing process in an inkjet printing apparatus that has multiple print heads arranged substantially along a line oriented perpendicular to a movement direction of a recording material, comprising the steps of:

generating a line scan to print a print line with said line of said print heads on said recording material, determining a mechanical mounting offset of each of said print heads relative to said line scan prior to printing, and said line scan measuring relative movement between the print heads and the recording material;

individually controlling the individual print heads with each said mechanical mounting offset relative to the line scan to correct for the respective mechanical offset by a timing of the ejection of the printing ink from nozzles of the print heads, print data prepared for the printing with the print heads being stored in a memory device upstream of the print heads;

transferring print data units to be printed by the individual print heads from the memory device to the respective print heads in a same order with which they are printed on the recording material; and controlling the order with which the print data units are transferred from the memory device to the print heads by means of request commands that are entered into a FIFO memory, wherein each request command identifies a print head and the order of the transfer of the print data units corresponds to an order of the request commands in the FIFO memory.

2. The method according to claim 1 wherein the line scan is generated by means of an incremental encoder that measures said relative movement between the print heads and the recording material, wherein the incremental encoder generates a pulse signal with multiple pulses between two line scans, and using these pulses the individual print heads are activated to eject the printing ink.

3. The method according to claim 1 wherein the print data units read out from the memory device are initially stored in a buffer from which they are transferred to the respective print heads as soon as a previous print data unit to be printed with the respective print head has been printed.

4. The method according to claim 1 wherein to transfer a print data unit a request command is read from the FIFO memory, and using the request command the corresponding print data unit is read from the memory device and relayed to the respective print head.

5. The method according to claim 1 wherein in the activation of the individual print heads the offset is converted into a respective calculated delay depending on print speed, wherein the individual print heads are activated with the respective calculated delay relative to the line scan.

6. The method according to claim 1 wherein the offset is established with a precision that is less than a diameter of a maximum image point.

7. The method of claim 1 wherein said determining of said mechanical mounting offset of each of said print heads relative to said line scan is determined by analyzing a print image generated by the print heads and measuring the mechanical offset of each print head relative to the line scan.

8. The method of claim 1 wherein the respective mechanical offsets for the respective print heads are stored in a register connected to an activation module for the print heads, said register also being connected to a request module connecting to a readout module through said FIFO memory, said readout module being connected to the activation module through respective buffers for the respective print heads.

* * * * *